US006266985B1

(12) United States Patent
Huttunen et al.

(10) Patent No.: US 6,266,985 B1
(45) Date of Patent: Jul. 31, 2001

(54) METHOD FOR IMPROVING LUBRICATION IN ROLLING

(75) Inventors: Kari Huttunen; Jukka Kömi; Raimo Levonmaa; Pentti Saxlund, all of Tornio (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/587,628

(22) Filed: Jun. 5, 2000

(30) Foreign Application Priority Data

Jun. 14, 1999 (FI) ..... 991362

(51) Int. Cl.[7] ..... B21B 45/02
(52) U.S. Cl. ..... 72/41; 72/236
(58) Field of Search ..... 72/39, 41, 42, 72/200, 201, 43, 44, 45, 236

(56) References Cited

U.S. PATENT DOCUMENTS 4,691,549 * 9/1987 Adair ..... 72/39
5,006,181 * 4/1991 Masuda et al. ..... 72/42

FOREIGN PATENT DOCUMENTS 3077701 4/1991 (JP) .

* cited by examiner

*Primary Examiner*—Lowell A. Larson
(74) *Attorney, Agent, or Firm*—Smith-Hill and Bedell

(57) ABSTRACT

The invention relates to a method for improving the lubrication of the edges and ends of objects to be rolled, particularly hot rolled, said objects consisting of essentially planar surfaces and being for example metal sheets or strips. According to the invention, the lubricating medium is fed so that it is applied on the edge area of the object to be rolled (1, 21, 31), essentially during the whole rolling pass, and so that lubricating medium is applied, when beginning or finishing a rolling pass, essentially along the whole width of the object to be rolled (1, 21, 31), in the immediate vicinity of the ends of the object to be rolled.

16 Claims, 6 Drawing Sheets

Figure 1:
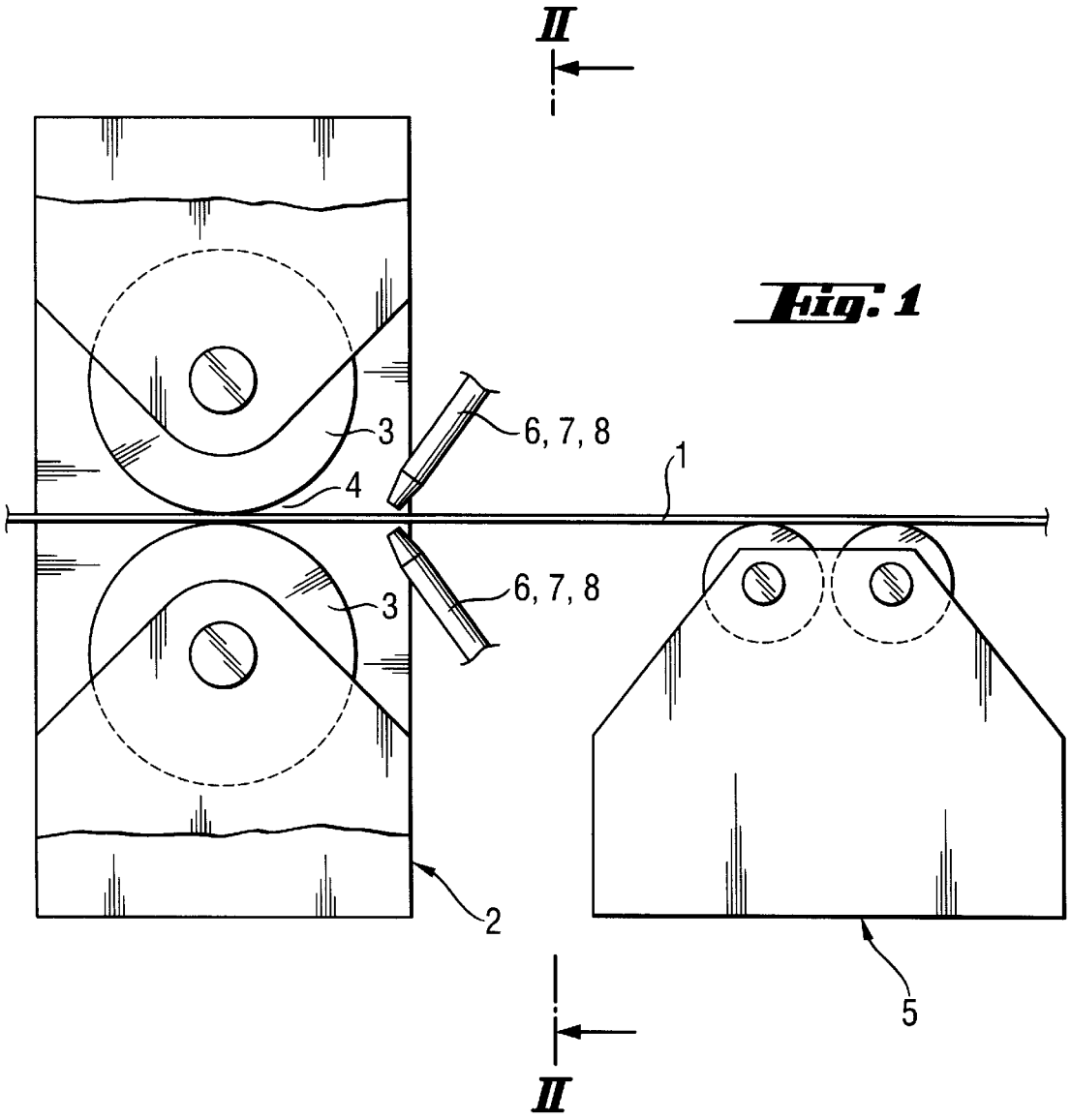

II 3
6, 7, 8
1
4
3
6, 7, 8
2
5
II

METHOD FOR IMPROVING LUBRICATION IN ROLLING

The present invention relates to a method for improving the lubrication of the edges and ends of pieces to be rolled, particularly hot rolled, said pieces consisting of essentially planar surfaces, such as metal sheets or strips, in order to diminish the wearing of the rolls and reduce the rolling force.

In the hot rolling of metal objects, the friction force between the object to be rolled and the rolling mill pulls the object to be rolled into the rollgap of the rolling mill. Thereafter the friction force is diminished and reaches the value zero at a point where the velocities of the object to be rolled and the rolling mill are equal. In order to make possible the rolling of the object to be rolled, the friction force between the object to be rolled and the rolling mill must be made strong enough. The magnitude of the required friction force is particularly affected by the properties of the object to be rolled. In case the properties of the object to be rolled are changed during rolling, the rolling mills are subjected to additional strain, which further leads to the wearing of the rolling mills.

In hot rolling, such as the hot rolling of stainless steel, the wearing of the rolling mills causes remarkable expenses. A particular problem is the wearing of the edge of the object to be hot rolled, which is for instance a sheet or a strip. On one hand, this is due to the lower temperature of the edge, and on the other hand on the high thermal strength of stainless steel. Moreover, for example in Steckel-type hot rolling, the ends of the object to be hot rolled are cooled, wherefore the rolling force required for rolling the ends is essentially increased; hence the hot rolling process becomes more difficult, and the reduction must be restricted.

Moreover, the wearing of rolling mills leads to the weakening of the quality of the surface of the object to be rolled, in which case part of the rolled product must be classified as scrap. In order to prevent the wearing of rolling mills, there is generally used lubrication, which helps reduce the friction force required in the rolling process. Usually lubrication is applied only in the roll itself.

The object of the present invention is to achieve an improved method for reducing the friction force required for rolling, particularly in hot rolling, by lubricating, apart from the rolls, also the object to be rolled consisting of planar surfaces, at least for the parts that are essential in the rolling process.

According to the invention, the lubrication of the object to be rolled and the roll is advantageously carried out so that while the object to be rolled, essentially consisting of planar surfaces and made of metal, such as stainless steel, is in the rollgap, the medium used for lubrication is applied along the whole edge area of the object to be rolled essentially during the rolling pass, and also at the ends of the object to be rolled, essentially along the whole width of said object. The medium used for lubrication is fed directly onto the surface of the object to be rolled, essentially on that area of said surface where the lubricating medium is advantageously used. The lubricating medium can also be fed onto the roll surfaces, advantageously on that point of the roll which during rolling is in contact with those areas of the object to be rolled where the lubricating medium is advantageously used.

The width of the edge area of the object to be rolled, where the lubricating medium is fed according to the invention, is 5–40%, advantageously 10–30% of the whole width of the object to be rolled. The length of the end of the object to be rolled, where the lubricating medium is fed according to the invention, is 2–20%, advantageously 5–10% of the length of the object to be rolled when measured after each rolling pass. During a rolling pass, the whole object to be rolled passes once through the rollgap, and hence, as the rolling proceeds, also the length where the lubricating medium is fed along the whole width of the object is increased.

According to the invention, the feeding of the lubricating medium onto the surface of the object to be rolled and likewise onto the surface of the roll is advantageously carried out in the proceeding direction of the object to be rolled, by means of at least one feeding device installed in the vicinity of the lubricating medium feeding spot, prior to the roll. The feeding device used for feeding the lubricating medium comprises at least one feeding member, whereby the lubricating medium can be fed onto the desired spot. The feeding of the lubricating medium takes place in connection with the rolling processes, either in continuous or discontinuous operation, essentially depending on the position of the feeding device with respect to the object to be rolled and to the roll.

In a preferred embodiment of the invention, the lubricating medium is fed onto the surface of the object to be rolled, so that at least three feeding members are directed towards each surface to be rolled in said object. The feeding members are mutually positioned so that one is directed to point essentially to the center of the surface to be rolled, whereas the two other feeding members are directed to point towards the edge areas of the object to be rolled, one towards each edge. Furthermore, the feeding members are mutually positioned so that they are connected to the same lubricating medium conduit, in which case the feeding members together constitute one feeding device. The feeding members can also be positioned so that each feeding member is connected to an individual lubricating medium conduit, in which case each feeding member constitutes a separate feeding device. Moreover, the feeding members can also be positioned so that for example the feeding members directed to point towards the center of the object are connected to a common lubricating medium conduit, whereas each of the feeding members directed to point towards the edge areas of the object are connected to individual lubricating medium conduits. The feeding members are advantageously made to operate so that the feeding members directed to point towards the edges of the object to be rolled are in operation essentially throughout the whole rolling pass of said object. On the other hand, the feeding member directed to point towards the center of the object to be rolled is kept in operation only when an end of the object to be rolled or a predetermined area in the immediate vicinity of said end is located in the effective range of the feeding member in question. Consequently, when feeding lubricating medium to the end or to the immediate vicinity of the end of the object to be rolled, the feeding is kept in operation only when starting and finishing the rolling pass. Depending on the width of the object to be rolled, the number of feeding members directed to point towards the center of the object may be one or several, in order to obtain the whole object in the vicinity of the end, essentially along the whole width of said object, within the effective range of the applied lubricating medium.

At least part of the lubricating medium can advantageously be fed onto the surface of the roll located in the rolling mill. Now, in similar fashion as when feeding medium onto the surface of the object to be rolled, towards the roll surface there are directed at least three feeding members which are positioned and made to operate so that the medium can be fed to the edges of the object to be rolled, essentially along the whole length of the object to be rolled, and to the end or to the immediate vicinity of the end of the object to be rolled, essentially along the whole width of the object to be rolled.

The medium nozzles directed towards the edges of the object to be rolled can also be installed so that the feeding members are located essentially on the same level with the object to be rolled. Now the lubricating medium is fed towards the edge of the object to be rolled, wherefrom the medium is spread onto the surfaces to be rolled, defined by the edge of the object to be rolled.

When applying the method according to the invention for improving lubrication in connection with rolling, the capacity of the hot rolling mill can be increased, because the rolling force at the end of the object to be rolled is diminished. In that case the number of the rolling operations, i.e. rolling passes, required of the object to be rolled is reduced. The capacity of a hot rolling mill can also be extended by extending the hot rolling cycle. Thus also the working life of the rolls used in the rolling process is extended, because the wearing of the working rolls that are in immediate contact with the object to be rolled is slowed down. Respectively, the operating costs of the hot rolling mill are reduced, because the wearing effect that wears the working roll which is in immediate contact with the ends of the object to be hot rolled is diminished, when the object to be rolled is lubricated in the immediate vicinity of the ends thereof, along the whole width of said object. Likewise, the wearing effect of the edges of the object to be hot rolled on the working rolls that are in immediate contact with the object to be rolled is diminished with edge lubrication. Moreover, the quality of the object to be hot rolled is improved, because the control of the object becomes more effective as the edge wearing of the working roll is diminished. In addition to this, the operating costs of the lubricating medium are advantageously reduced, because the lubrication is essentially directed only to places where it is useful.

Figure 2:
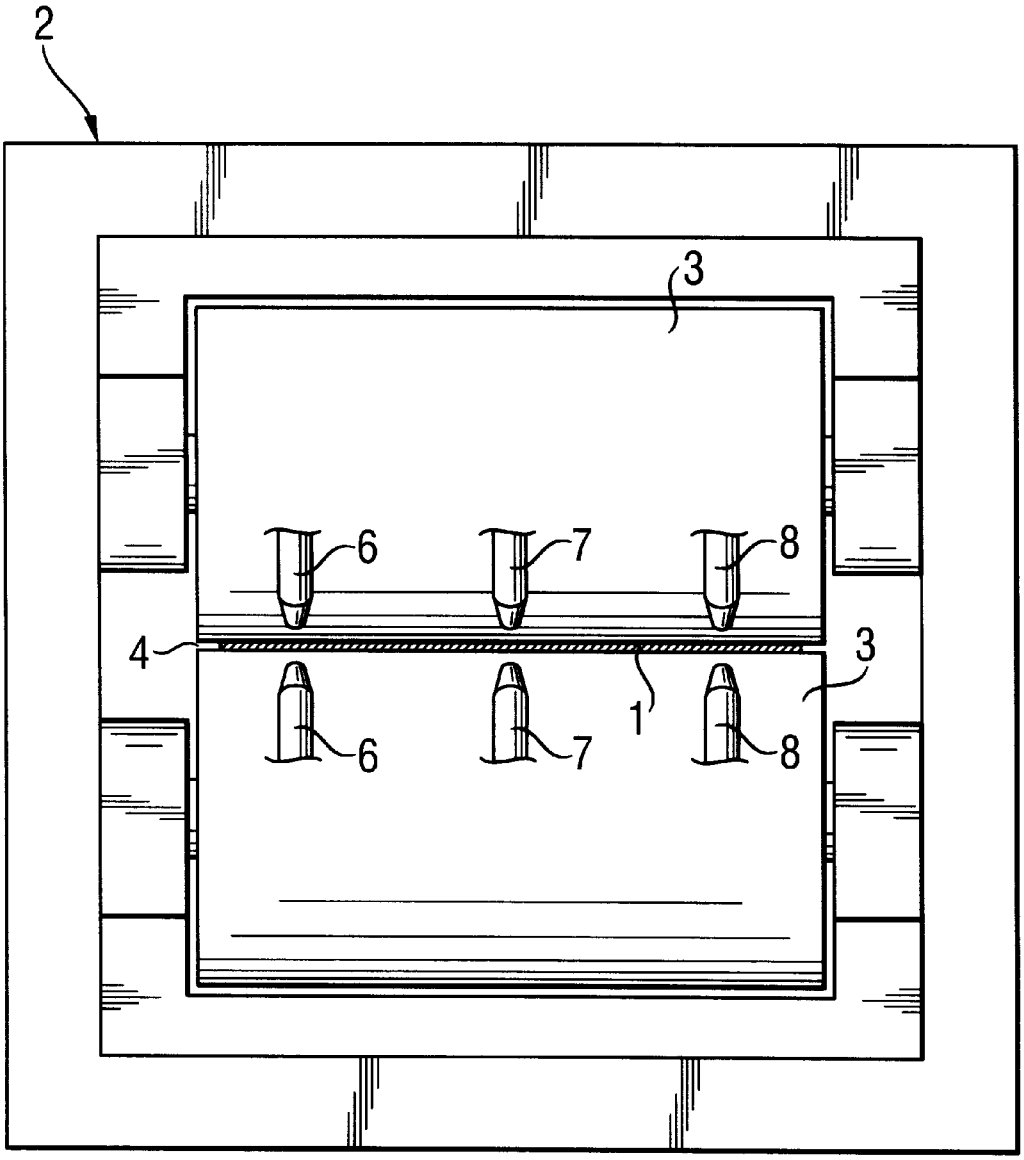
Figure 3:
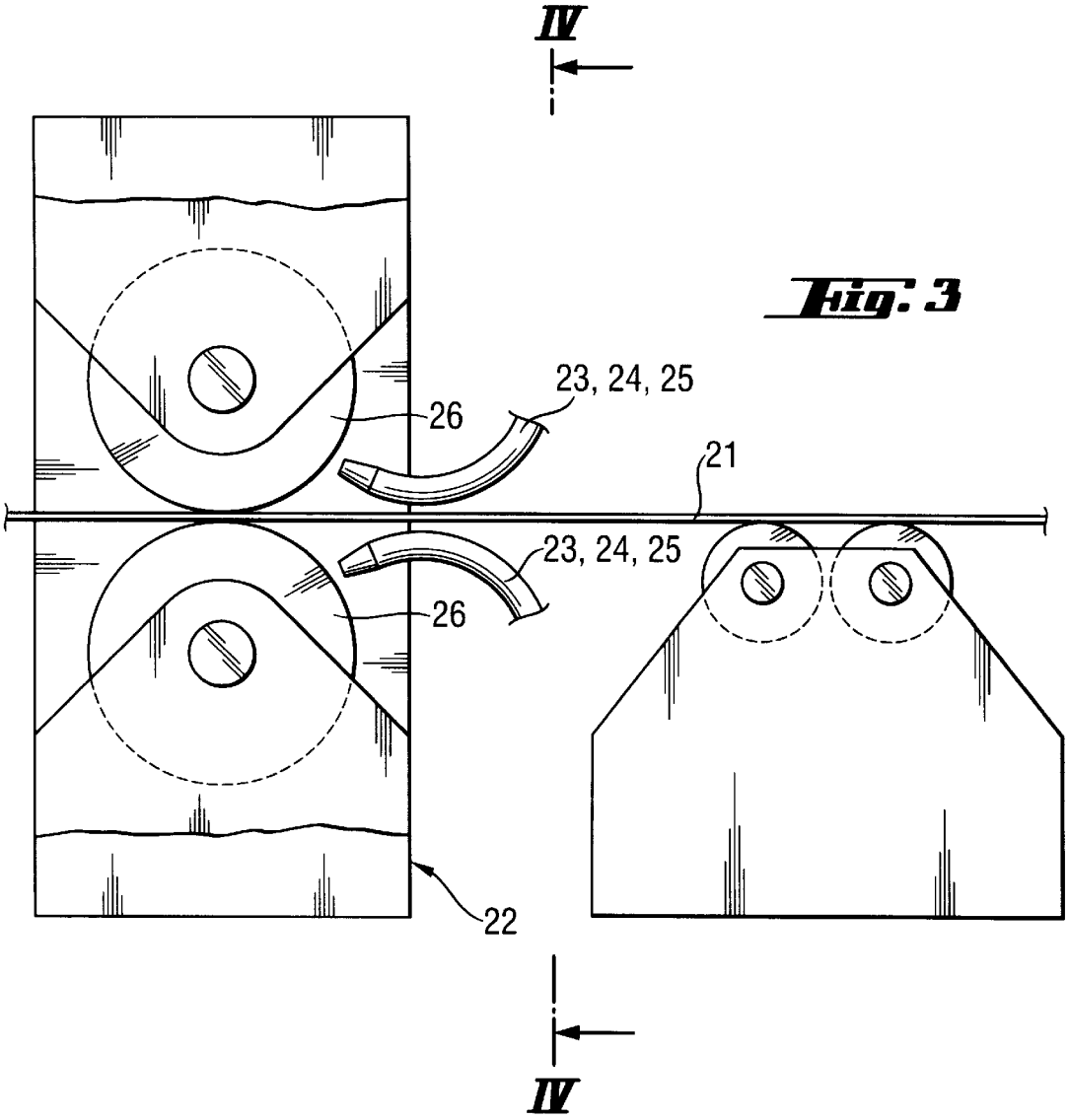
Figure 4:
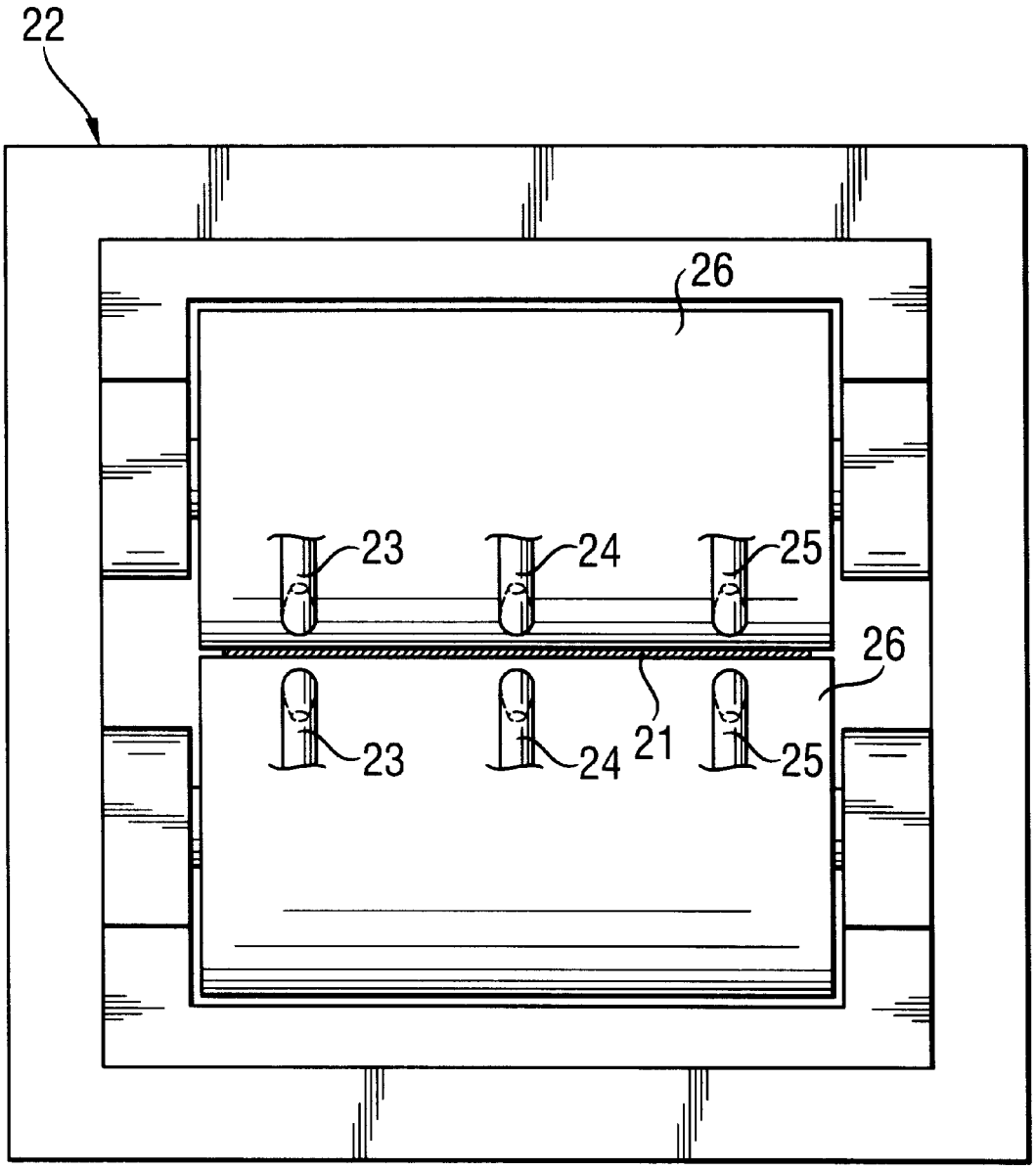
Figure 5:
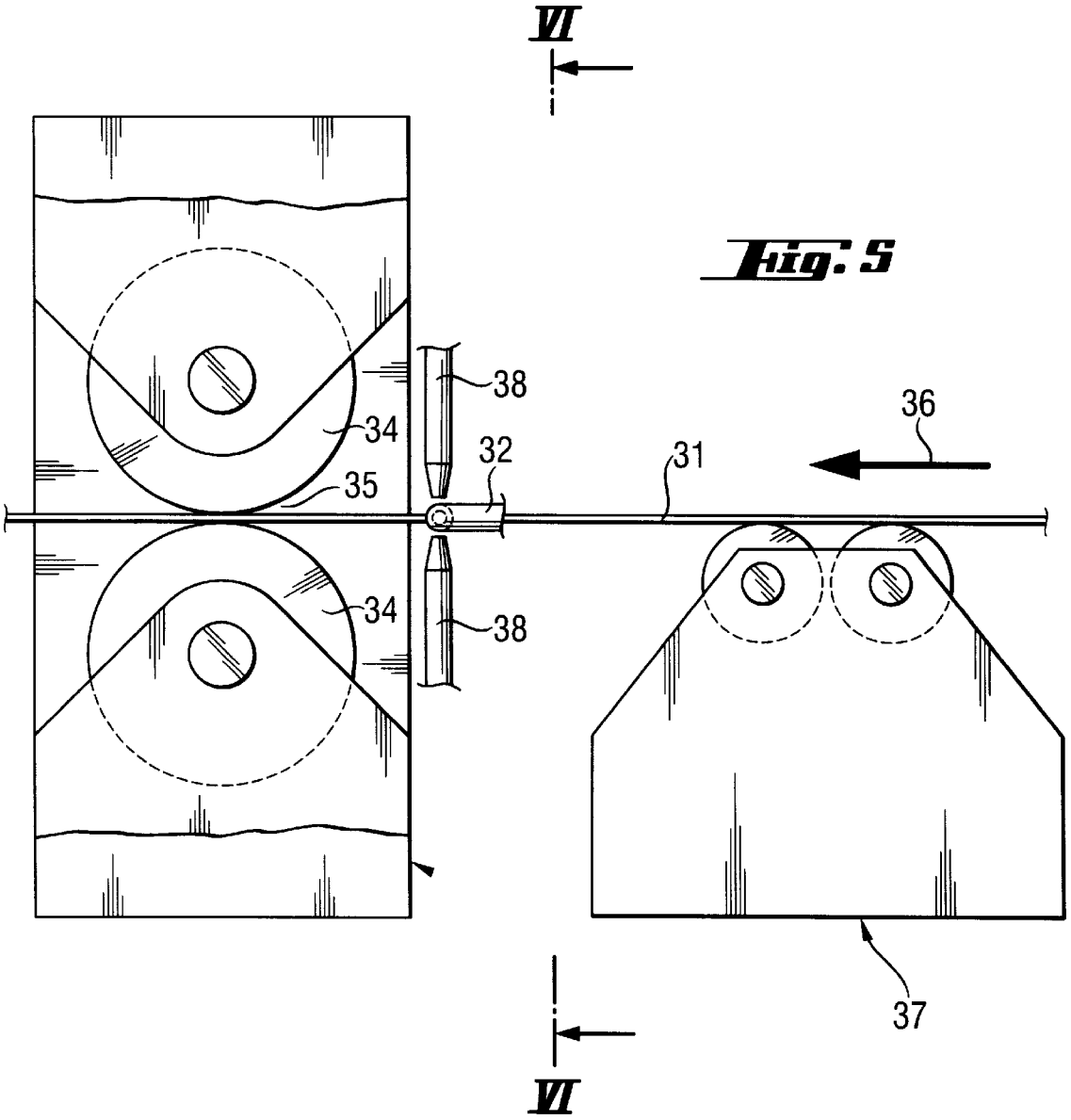
Figure 6:
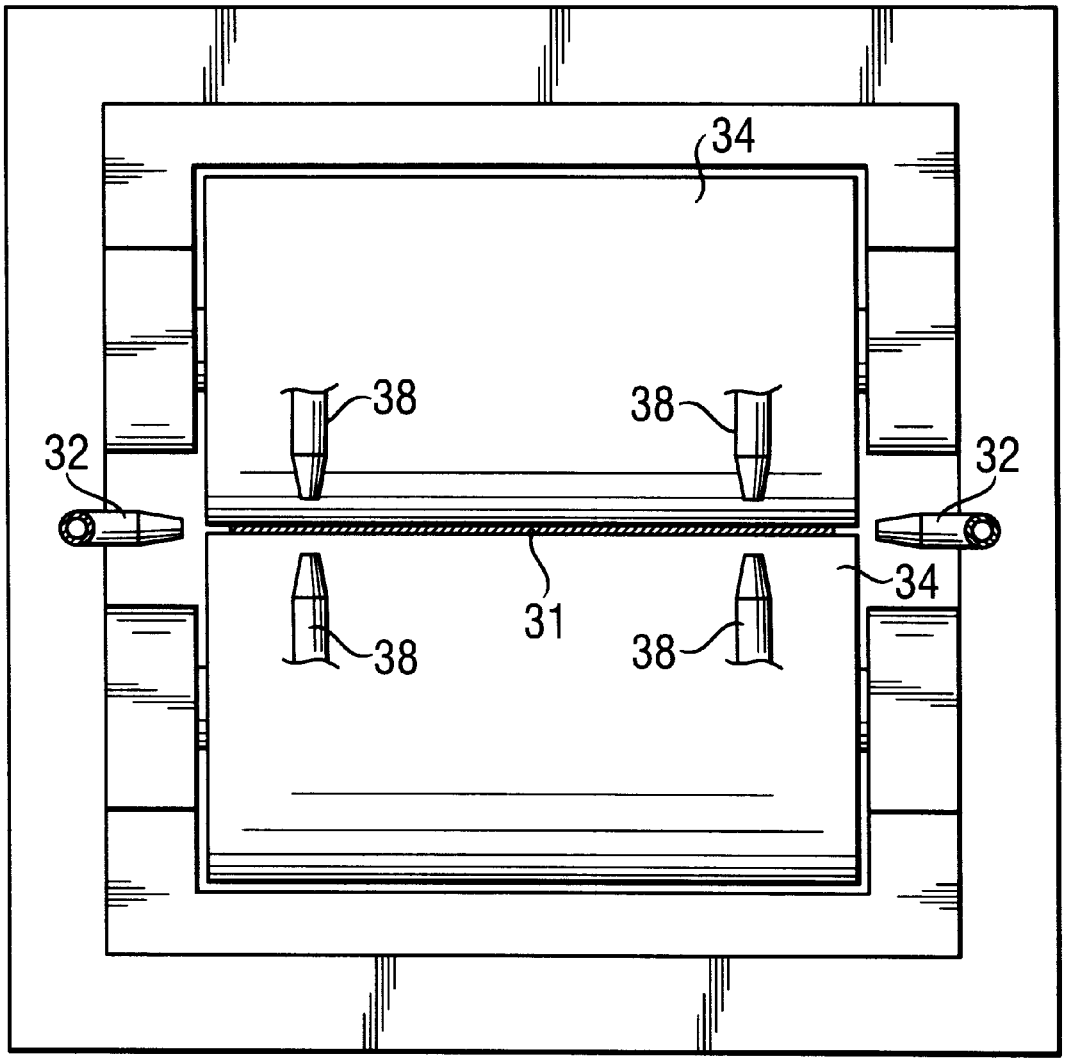

The invention is described in more detail below, with reference to the accompanying drawings, where FIG. 1 shows a preferred embodiment of the invention, seen in a schematical side-view illustration, FIG. 2 illustrates the embodiment of FIG. 1, seen in the direction II—II, FIG. 3 shows another preferred embodiment of the invention, seen in a schematical side-view illustration, FIG. 4 illustrates the embodiment of FIG. 3, seen in the direction IV—IV, FIG. 5 shows a third preferred embodiment of the invention, seen in a schematical side-view illustration, and FIG. 6 illustrates the embodiment of FIG. 5, seen in the direction VI—VI.

According to FIGS. 1 and 2, a stainless steel strip 1 is rolled in a hot rolling mill 2, so that the strip 1 is fed at a high temperature into the rollgap 4 between the working rolls 3 of the rolling mill. The stretch of strip 1 that is not yet fed into the rollgap 4 is supported by support members 5. Above and below the trajectory of the strip 1, defined by the support members 5 and the rollgap 4, in the immediate vicinity of said trajectory, there are installed feeding members 6, 7 and 8 in order to feed the medium used for lubricating the strip onto the surface of the strip 1. Through the feeding members 6 and 8, which are installed essentially near to the edge of the strip 1, lubricating medium is fed onto the surface of the strip 1, essentially continuously, as the strip 1 is fed into the rollgap 4 of the hot rolling mill. On the other hand, through the feeding member 7, which is installed essentially centrally with respect to the strip 1 to be rolled, lubricating medium is fed onto the surface of the strip 1 only when starting or finishing a rolling pass of the strip 1. Thus, via the feeding member 7, lubricating medium is fed only to the front or rear end of the strip 1, or to the immediate vicinity of the front or rear end of the strip 1, essentially along the whole width of the strip 1.

In the embodiment according to FIGS. 3 and 4, when rolling a stainless steel strip 21 in a rolling mill 22, the lubricating medium is fed through feeding members 23, 24 and 25 onto the working roll 26 of the rolling mill 22, so that the top and bottom surfaces of the object to be rolled get in contact with the medium. Two of said feeding members, i.e. feeding members 23 and 25, are installed, with respect to the working rolls 26, so that the medium is directed towards the edge parts of the working rolls essentially during the whole rolling pass. The third feeding member 24 is installed so that the medium is directed towards the central part of the working roll 26 when beginning and ending a rolling pass, in which case the ends of the strip 21, and the sections of the strip 21 that are located in the immediate vicinity of the ends, are obtained in the effective range of the lubricating medium, essentially along the whole width thereof.

In the embodiment according to FIGS. 5 and 6, the feeding members 32 directed towards the edges of the strip 31 to be rolled are installed on the level of the trajectory defined by the rollgap 35 of the roll 34 and the support members 37 preceding the roll 34 in the proceeding direction 36 of the strip, in the immediate vicinity of the edge of the strip 31 to be rolled. Now the lubricating medium is directed, by feeding it through the feeding members 32 and 33, towards the edge of the strip 31, wherefrom the medium is spread on both surfaces of the strip to be rolled. Moreover, above and below the strip 31 to be rolled, there is installed a feeding member 38 that feeds the lubricating medium onto the surfaces to be rolled of the strip 31 when starting and finishing a rolling pass, so that lubricating medium is fed to the ends of the strip 31 or to the immediate vicinity of the ends of the strip 31, essentially along the whole width of the strip 31.

What is claimed is:

1. An improved method of rolling an object having two essentially planar opposite main surfaces, each main surface having two opposite longitudinal edge regions and a longitudinal medial region between the edge regions, employing a rolling mill having working rolls defining a rollgap, said method including rolling the object in at least one rolling pass and applying lubricating medium to the object as the object enters the rollgap, wherein the improvement comprises:

applying lubricating medium to the edge regions of the main surfaces of the object during substantially the entire rolling pass, and applying lubricating medium to the medial regions of the respective main surfaces of the object substantially only at beginning and end of the rolling pass, whereby lubricating medium is applied over substantially the entire width of the main surfaces substantially only in end regions of the main surfaces.

2. A method according to claim 1, comprising feeding the lubricating medium directly onto the main surfaces of the object.

3. A method according to claim 1, employing feeding members for feeding lubricating medium, comprising feeding the lubricating medium directly onto the main surfaces of the object.

4. A method according to claim 1, comprising feeding the lubricating medium onto the working rolls, whereby the lubricating medium is applied to the main surfaces of the object by transfer from the working rolls.

5. A method according to claim 1, employing feeding members for feeding lubricating medium, comprising feeding the lubricating medium onto the working rolls, whereby the lubricating medium is applied to the main surfaces of the object by transfer from the working rolls.

6. A method according to claim 1, wherein the object has two opposite longitudinal edges connecting the two opposite main surfaces, and the method comprises applying lubricating medium to the longitudinal edges of the object.

7. A method according to claim 1, employing feeding members for feeding lubricating medium, wherein the object has two opposite longitudinal edges connecting the two opposite main surfaces, and the method comprises feeding the lubricating medium onto the longitudinal edges of the object.

8. A method according to claim 1, employing feeding members for feeding lubricating medium, and the method comprises operating at least one of the feeding members substantially continuously throughout the rolling pass.

9. A method according to claim 1, employing feeding members for feeding lubricating medium, and the method comprises operating at least one of the feeding members intermittently during the rolling pass.

10. A method according to claim 1, wherein the width of each edge region of the main surface is 5–40% the entire width of the object.

11. A method according to claim 10, wherein the width of each edge region of the main surface is 10–30% the entire width of the object.

12. A method according to claim 1, wherein the length of each end region of the object is 2–20% the entire length of the object after the rolling pass.

13. A method according to claim 12, wherein the length of each end region of the object is 5–10% the entire length of the object after the rolling pass.

14. A method according to claim 1, comprising rolling the object in multiple rolling passes, and wherein the method comprises applying lubricating medium to the edge regions of the main surfaces of the object substantially throughout each rolling pass, and applying lubricating medium to the medial regions of the respective main surfaces of the object substantially only at beginning and end of each rolling pass.

15. A method according to claim 14, wherein the length of the end regions of the main surfaces to which lubricating medium is applied in each rolling pass is 2–20% the entire length of the object after the rolling pass.

16. A method according to claim 14, wherein the length of the end regions of the main surfaces to which lubricating medium is applied in each rolling pass is 5–10% the entire length of the object after the rolling pass.

* * * * *